US006041962A

United States Patent [19]

Pollock

[11] Patent Number: 6,041,962

[45] Date of Patent: Mar. 28, 2000

[54] PRODUCT-TIPPING DEVICE FOR VENDING MACHINE

[75] Inventor: Richard A. Pollock, Martinsburg, W. Va.

[73] Assignee: Automated Merchandising Systems, Kearneysville, W. Va.

[21] Appl. No.: 09/069,245

[22] Filed: Apr. 29, 1998

[51] Int. Cl.[7] ..... G07F 11/00

[52] U.S. Cl. ..... 221/75; 221/312 R

[58] Field of Search ..... 221/75, 261, 311, 221/312 R, 241, 242

[56] References Cited

U.S. PATENT DOCUMENTS

| | | | |
|---|---|---|---|
| 3,469,738 | 9/1969 | Schuller | 221/75 |
| 3,828,971 | 8/1974 | Offutt et al. | 221/75 |
| 3,861,561 | 1/1975 | Wittern et al. | 221/75 |
| 3,993,215 | 11/1976 | Cox et al. | 221/75 |
| 4,148,412 | 4/1979 | Lotspeich | 221/75 |
| 4,744,490 | 5/1988 | Albright et al. | 221/75 |
| 5,307,941 | 5/1994 | Siegal | 221/75 |

*Primary Examiner*—Kenneth W. Noland
*Attorney, Agent, or Firm*—Pillsbury Madison & Sutro LLP

[57] ABSTRACT

The mounting channel for product price, product identity and/or column identity chips or cards provided across the front of a tray of a glass-front vending machine of the motorized helical mechanism type, is provided with one or more chips or cards which have a tab which protrudes upwards beyond the product support surface of the tray, at a location determined to be appropriate for intersecting a like corner of each package conveyed to the foremost position and off the front edge of that tray, for thereby predetermining the spatial orientation of the package as it begins to fall, for preventing bridging of the package between the tray and the glass front. The tabbed chip or card may also provide typical product price, product identity and/or column identity information.

10 Claims, 2 Drawing Sheets

PRODUCT-TIPPING DEVICE FOR VENDING MACHINE

BACKGROUND OF THE INVENTION

The present invention relates to improvements in packaged-article vending machines of the type in which articles yet to be vended are ranked in succession among the turns of a horizontally arranged helix which projects forwardly above a horizontal tray ranked behind a glass front. Upon making payment for and selecting an article to be vended, the customer momentarily pauses and watches, as a motor turns the helix sufficiently to advance the leading packaged article product sufficiently that the leading packaged article falls off the front edge of the tray and descends through a vending space to land in an output chute where it is accessible for retrieval by the customer.

A popular feature of currently available packaged-article product-vending machines of the type referred to above which are snack-vending machines, is having at least one snack-vending column. Typically, this is a comparatively wide column, e.g. 5.5 inches (14 cm) wide, and at least two of the manufacturers which currently sell such machines provide two cooperatingly operated counter-rotatable helices for vending the comparatively large snack packages from such wide columns.

Typically, the product-vending machines which have product impounding and advancing helices arranged in respective side by side columns over a set of vertically spaced horizontally arranged trays, are of modular construction, in the sense that, depending on the sizes of the products which are to be vended, more or fewer trays can be provided, arranged to have more or fewer columns, the narrower columns being served by one helix each, and (in the above-described popular machines), the wider columns each being served by two helices which are arranged to be correspondingly counter-rotated.

Although modularity is considered to be an attractive feature, the need for two motorized helices operating coordinatingly to vend the packages in one wide column is believed not to be an optimal solution, due to the expense and complexity of requiring twice as many motorized helices for vending half as much product. In other words having it cost more to vend less is not the best, if the extra investment in motorized helices can be avoided.

Generally in glass-front vending machines of the motorized helical mechanism type, there is a fixed distance (typically of about 9 inches, 23 cm) between the fronts of the columns and the rear surface of the glass. Some snack manufacturers prefer to vend their products in facially large, tall but thin packages, in order to supply generous amounts of snack food to the customer, to provide a perception of a generous amount, and yet to fit, the packages to the 'pockets' defined from above between successive turns of the respective spirals or pair of spirals.

There is a non-trivial likelihood that if a snack product package which is taller than the front-to-rear depthwise dimension of the vend space is vended from a wide column of a glass-front vending machine of the motorized helical mechanism type, particularly one which has one helix per column, happenstantial orientation of the package as the package is conveyed off the front edge of the respective tray and begins its descent in the vend space towards the outlet hopper, will cause the package to tilt over towards the glass front and become hung-up, bridged between the tray and the glass front, tempting the customer to administer rocking motion to the machine to assist delivery of the package, possibly to the detriment of the machine and/or to the customer.

SUMMARY OF THE INVENTION

The mounting channel for product price, product identity and/or column identity chips or cards provided across the front of a tray of a glass-front vending machine of the motorized helical mechanism type, is provided with one or more chips or cards which have a tab which protrudes upwards beyond the product support surface of the tray, at a location determined to be appropriate for intersecting a like corner of each package conveyed to the foremost position and off the front edge of that tray, for thereby predetermining the spatial orientation of the package as it begins to fall, for preventing bridging of the package between the tray and the glass front. The tabbed chip or card may also provide typical product price, product identity and/or column identity information.

Each leading product as its turn comes to be vended, is so conveyed by the spiral that its corner strikes a protrusion that guides spatial orientation of the product, causing it to fall off the forward edge of the tray in a way that avoids bridging between the tray and the glass front, despite the shallowness of the space back of the glass front. In the preferred form, the protrusion is removable and fits in the product price slot, doing double duty as the product price sign.

BRIEF DESCRIPTION OF THE DRAWINGS

A preferred embodiment of the invention is described in further detail with reference to the attached drawing, in which.

DETAILED DESCRIPTION

Figure 1:
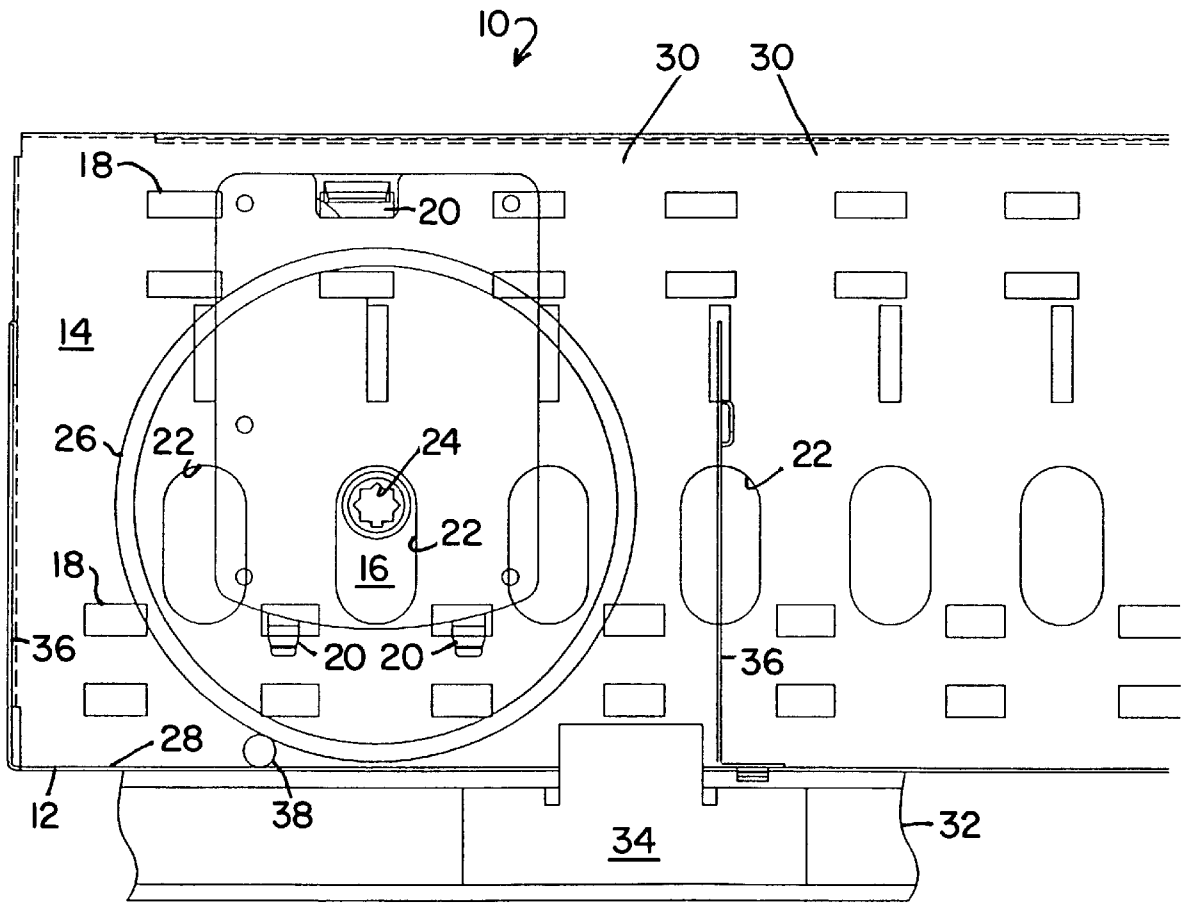
FIG. 1 is a fragmentary, schematic front elevational view of a packaged-article product-vending machine provided with a product-tipping device in accordance with principles of the present invention.
Figure 4:
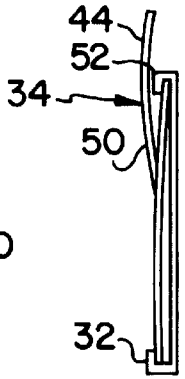
FIG. 4 is an end elevational view showing the product-tipping device mounted in the tab mounting strip of FIG. 1.

A packaged-article product-vending machine is fragmentarily illustrated at 10 in FIG. 1. The machine 10 as a whole, may be generally of the type which is shown in Pitel et al, U.S. Pat. No. 3,952,915, issued Apr. 27, 1976 and Lennartson, U.S. Pat. No. 4,149,653, issued Apr. 17, 1979.

In the portion which is illustrated (in front elevational view), the machine 10 is shown including a horizontally arranged tray 12 (which generally would be one of several similar trays), supported in the cabinet (not shown) of the machine at a single series at a plurality of different levels, the tray 12 being, for instance, one disposed at an intermediate level, with one or more others (not shown) above it, and one or more others (not shown) below it. Each tray extends from the left inner cabinet supporting wall (not shown) to the right inner cabinet supporting wall (not shown).

Each tray of the machine 10 further includes an upstanding rear wall 14 which is supported sufficiently forwardly of the rear of the outer cabinet (not shown), as to permit each helix operating motor assembly 16 to be mounted to the rear of the respective rear wall 14.

By preference, each rear wall 14 is provided a plurality of regularly spaced locations along its width, above the location of each tray 12, not only with a plurality of openings 18 which permit a helix-operating motor assembly 16 to the rear wall, by appropriate fasteners such as clips 20, but also with openings 22 through which the drive chuck 24 of each motor assembly 16, when so mounted, is available for plugging-in of the rearwardly projecting axial drive stem (not shown), of non-circular transverse cross-sectional shape, for unidirectional rotation of the helix (suggested at 26) about the longitudinal axis of the helix. Typically, the helix 26 is made of stainless steel.

The helix 26 is arranged to be rotated by the motor assembly 15 in a stepwise fashion, e.g. through a fixed number of rotational degrees, or until a certain amount of time has elapsed, and/or until a sensing device senses and reports that an event has occurred, whichever happens first, or whichever happens last. The rear end of the helix 26 is supported from the rear wall 14 by virtue of the stem of the helix being plugged into the chuck 24 of the motor assembly and the motor assembly 16 being mounted by the clips 20 to the rear wall 14. Forwardly of its stem, the helix 26 is supported for rotation by simply resting on the upper surface 28 of the tray 12.

As stated above, by preference the space over the surface 28 on one tray 12 is divided, at least notionally and preferably also physically, into a plurality of side-by-side, forwardly-rearwardly extending horizontal columns 30. In the drawing, two columns are visible; these could (and usually would) be more than two. These may be equally as wide as one another, or different widths, e.g. for respectively vending packages having the same, or different widths, each column being served by (preferably) one stepwise-driven helix 26 (or, less preferably) by two counter-rotating stepwise-driven helices, ranked side by side, with spacing between them.

In the instance depicted, the front edge of the tray 12 is shown further provided with a tab-mounting strip 32, such is conventionally used for holding small price and product identifying cards or chips on the fronts of shelves on traditional supermarket shelving. The purpose of provision of this structure in the machine 10 is similar, i.e. to provide a site for mounting one or more cards or chips 34 at the front of each column indicating the name of the product available from the particular column, and/or its price, and/or the address of the column (e.g. "C7") for indicating the seventh column over from the left on the third tray down from the top of the array of columns on the machine, this address being adapted to be entered by the customer on the selector panel (not shown) on the machine 10, for selecting the particular column the leading product in the respective foremost filled inter-turn space of the helix of which the customer wishes to select to have vended to him or to her. Typically, these cards or chips 34 are made of flexible material, so as to be able to be resiliently flexed to swap them into or out of the strip 32, and so as to be able to be manually urged leftwise or rightwise so as to assume and maintain a given spatial location relative to the respective column.

The tray 12 typically is made of zinc-coated steel sheet, or stainless steel, or a rugged, molded synthetic polymeric plastic material. By preference, the tray 12 has a plurality of holes (not shown) pinched, drilled, pierced, molded or otherwise formed therethrough at a plurality of regularly spaced locations, correspondingly located relative to the sets of openings 18 and 22, for facilitating modular setting up of the machine 10.

For instance, one array of the openings through the tray 12 can be used for mounting at selected sites upright sidewalls 36 which laterally separate respective columns 30 from one another (or which, if provided, separate a leftmost column 30 from the left inner wall (not shown) of the inner cabinet of the machine, or which, if provided, separate a rightmost column 30 from the right inner wall (not shown) of the inner cabinet of the machine).

The helix 26, in addition to its rearwardly axially projecting axially central base, prong or stem (not shown), has a plurality of helical turns (typically 8–20, e.g. 14), a diameter typically of 1.5 to 4 inches, about 4–10 cm) and is about 1–3 feet (about 31–93 cm) long, not counting its drive stem. At the forward end, which preferably is flush, or nearly flush with the front edge of the shelf, simply runs out, i.e. is "open", so that a product which, by stepwise rotation of the helix while nested between two turns of the helix, while laterally confined between two respective sidewalls 36, upon further stepwise rotation of the helix simply becomes unsupported from below as it is conveyed forwardly of the front edge of the shelf, whereupon it falls through a vend space (typically about 6–9 inches, about 15–23 cm) in front-to-rear dimension between the front edge of the tray 12 and the rear of the glass front (not shown) of the machine 10. The dimensions given are meant to exemplify; clearly, the machine 10 and its described components could be changed substantially in absolute or relative size.

In contrast to conventional product price/product identification column identification chips or cards, the chip or card 34 has an upwardly projecting tab 44 which, when the chip or card is flexed and spring or slid into the channel 40 of the mounting strip 32, projects above the support surface 28 of the tray 12.

The chip or card 34 preferably is held in place by resilience and/or friction, so that it maintains the location at which it has been placed, until it is intentionally manually removed by the person servicing the vending machine.

The chip or card 34 is placed at a location determined, e.g. by educated guess, trial and error, and/or markings on the mounting strip 32, and/or instructions that come with the chips or cards based on experimentation, to be appropriate for causing its tab 44 to intersect a like lower corner of each package conveyed to the foremost position and off the front edge of the support surface 28 of the tray by turning of the respective spiral, for thereby predetermining spatial orientation of the package as it begins to fall. Accordingly, this little nudge or kick that each package is given as it is sent on its way into the vend space prevents the package from bridging between the front of the tray and the rear surface of the glass front of the vending machine.

The chip or card may be made of the conventional stock, e.g. polystyrene sheet or glazed paperboard that is conventionally used for making price signs for supermarket shelving (and for making conventional product price, product identity and column indicating signs for the trays of glass front vending machines.)

Figure 2:
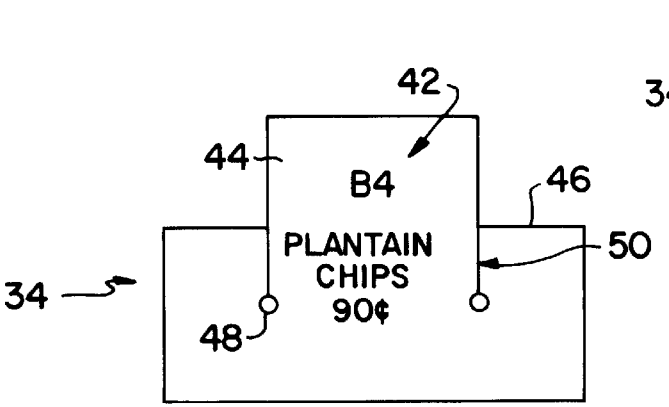
FIG. 2 is a front elevational view of the product-tipping of FIG. 1, shown by itself.

Indeed, the chip or card 34 may be provided with any or all of such informational indicia, as typically illustrated at 42 in FIG. 2.

Figure 3:
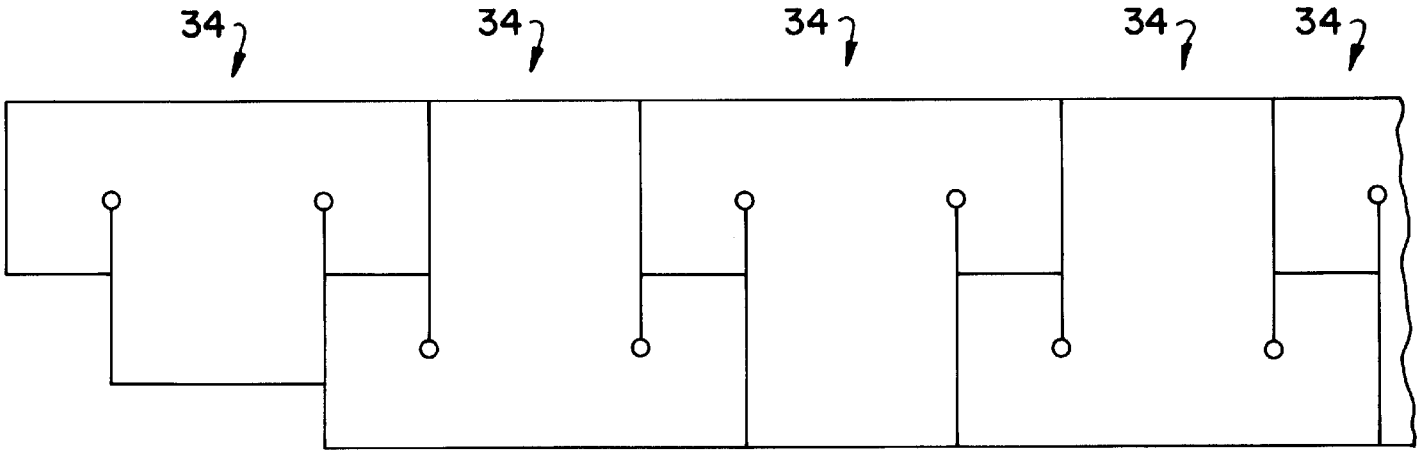
FIG. 3 is a diagramatic view illustrating how a series of product-tipping devices can be cut from a strip of stock material with minimal waste.

The individual chips or cards 34 may be made by slicing and punching them from strip stock, with little waste, e.g. as illustrated in FIG. 3.

It may be noticed that in FIG. 3, the tab 44 projects further above the upper edge 46 of the body of the chip or card relatively further than as shown in FIG. 2. If a tab, as furnished, is determined to be too tall, it can simply be trimmed, e.g. by use of a scissors, a paper cutter or the like.

The round holes 48 provided at the ends of the tab flexure portion 50 of the chip or card, serve to prevent propagation of rips or cracks along the vertical side edges of the tab flexure portion 50. The tab flexure portion 50 preferably extends down into the body of the chip or card, in order to lengthen the span over which the tab flexure portion resiliently bends to bypass the upper rim 52 of the channel.

Although it is preferred that the chips or cards 34 be used in connection with a vending machine of the type which has been described above with reference to FIG. 1, they can be used with other types of vending machines where the same or a comparable problem exists.

It should now be apparent that the product-tipping device for vending machine as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. A product-tipping device for a vending machine in which operation of a motorized product-advancing mechanism causes successively leading packages arranged in a column, to successively reach the forward extent of a support surface, lose support, and begin to fall through a vend space to a place where the respective product becomes accessible to a customer, the vending machine having a channel strip having an upper extent disposed at no higher elevation than level with said support surface, said product-tipping device comprising:

a chip or card having a body portion sized to be resiliently and or frictionally held in said channel wherever manually placed therein; and a tab portion which extends upwardly above said body for engagement with a lower edge portion with each said package as said package loses support from said surface, for nudging that package to have a predetermined orientation upon initiating falling of the package through the vend space.

2. The product-tipping device of claim 1, wherein:

said chip or card bears on a front face thereof indicia indicative of at least one of product price, product identity and vending machine column identity.

3. The product-tipping device of claim 1, wherein:

said body of said chip or card has two laterally opposite ends, and said tab has two correspondingly laterally opposite ends, at least one of which is located more medially of the chip or card than is the corresponding end of said body.

4. The product-tipping device of claim 3, wherein:

both lateral ends of the tab are disposed more medially of the chip or card than the corresponding ends of said body; and further including two cuts penetrating as continuations of respective lateral ends of the tab, down into the body, for providing of said tab and of a portion of said body delimited between said cuts, a tab flexure portion, which is arranged to be flexed relative to the remainder of the body, for permitting the tab to pass upwardly in front of and beyond said channel strip.

5. The product-tipping device of claim 4, wherein:

said cuts terminate in crack-propagation terminating round holes through said chip or card.

6. A vending machine having a product-tipping device, comprising:

a generally horizontal, upwardly presented product support surface having a forward extent;

a motorized product-advancing mechanism arranged to cause successively lending packages arranged in a column 1 to successively reach said forward extend of said support surface, lose support, and begin to fall through a vend space to a place where the respective product becomes accessible to a customer;

a channel strip having an upper extent disposed at no higher elevation than level with said support surface; and a product tipping device, comprising:

a chip or card having a body portion resiliently and/or frictionally held in said channel; and a tab portion which extends upwardly above said body for engagement with a lower edge portion with each said package as said package loses support from said surface, for nudging that package to have a predetermined orientation upon initiating falling of the package through the vend space.

7. The vending machine of claim 6, wherein:

said chip or card bears on a front face thereof indicia indicative of at least one of product price, product identity and vending machine column identity.

8. The vending machine of claim 6, wherein:

said body of said chip or card has two laterally opposite ends, and said tab has two correspondingly laterally opposite ends, at least one of which is located more medially of the chip or card than is the corresponding end of said body.

9. The vending machine of claim 8, wherein:

both lateral ends of the tab are disposed more medially of the chip or card than the corresponding ends of said body; and further including two cuts penetrating as continuations of respective lateral ends of the tab, down into the body, for providing of said tab and of a portion of said body delimited between said cuts, a tab flexure portion, which is arranged to be flexed relative to the remainder of the body, for permitting the tab to pass upwardly in front of and beyond said channel strip.

10. The vending machine of claim 9, wherein:

said cuts terminate in crack-propagation terminating round holes through said chip or card.

* * * * *